US010662607B2

(12) United States Patent
Trebil

(10) Patent No.: US 10,662,607 B2
(45) Date of Patent: May 26, 2020

(54) WATER DRAINAGE EDGING

(71) Applicant: Jesse B. Trebil, Atwater, MN (US)

(72) Inventor: Jesse B. Trebil, Atwater, MN (US)

( * ) Notice: Subject to any disclaimer, the term of this patent is extended or adjusted under 35 U.S.C. 154(b) by 0 days.

(21) Appl. No.: 16/108,053

(22) Filed: Aug. 21, 2018

(65) Prior Publication Data

US 2020/0063393 A1 Feb. 27, 2020

(51) Int. Cl.
*E02D 31/02* (2006.01)
*E04F 13/06* (2006.01)
*E04B 1/70* (2006.01)

(52) U.S. Cl.
CPC ..... *E02D 31/02* (2013.01); *E04B 1/7023* (2013.01); *E04F 13/06* (2013.01)

(58) Field of Classification Search
CPC ..... E02D 31/004; E02D 31/02; E02D 31/025; E04B 1/7046; E04B 1/7023; E04C 11/223; E04C 2003/023; E04H 4/141; E04F 13/06; E04F 2013/065
USPC ..... 52/102, 302.3, 169.5; 404/9
See application file for complete search history.

(56) References Cited

U.S. PATENT DOCUMENTS 2,703,002 A * 3/1955 Suskind ..... E04B 1/7023 52/302.3
2,896,559 A * 7/1959 Stephens ..... E04D 13/158 52/94
3,283,460 A * 11/1966 Patrick ..... E04B 1/703 52/274
3,676,952 A * 7/1972 Watts ..... A01G 9/28 47/33
3,872,195 A * 3/1975 Stegmeier ..... E04B 1/6803 264/35
3,942,292 A * 3/1976 Robinson ..... E04B 1/7046 52/204.2
4,969,289 A * 11/1990 Trifiletti ..... A01G 9/28 47/33
5,044,821 A * 9/1991 Johnsen ..... E02D 31/02 405/50
5,048,241 A * 9/1991 Gavin, Jr. ..... A01G 9/28 52/102
5,212,917 A * 5/1993 Kurtz ..... A01G 9/28 52/102
5,240,343 A * 8/1993 Strobl, Jr. ..... E01C 11/221 404/7
D339,199 S * 9/1993 Rynberk ..... D25/164
(Continued)

*Primary Examiner* — Kyle J. Walraed-Sullivan
(74) *Attorney, Agent, or Firm* — Skaar Ulbrich Macari, P.A.

(57) ABSTRACT

A water drainage edging segment includes a horizontally-extending bottom portion, a vertically extending top portion, and an angled intermediate section spanning between the bottom and top portions. The bottom portion defines a plurality of longitudinally spaced bottom channels that are oriented at one or both of a perpendicular angle and an oblique angle to the longitudinal axis of the edging segment. Each of the plurality of bottom channels are raised above a lowermost plane of the bottom portion to define an open passageway from a backside of the edging segment and laterally through the edging segment. The top portion defines a longitudinally extending upper rib portion that projects rearwardly from a front plane of the top portion to define a forward offset of the front plane and an upward facing contact surface.

19 Claims, 12 Drawing Sheets

(56) References Cited

U.S. PATENT DOCUMENTS 5,379,546 A * 1/1995 Popp ..... A01G 9/28 47/33
5,421,118 A * 6/1995 Bauer ..... A01G 9/28 47/33
5,456,045 A * 10/1995 Bradley ..... A01G 9/28 47/33
5,501,044 A * 3/1996 Janesky ..... E04B 1/7023 404/4
D372,547 S * 8/1996 Sjodin ..... D25/164
5,544,445 A * 8/1996 Mantilla ..... A01G 9/28 47/33
D378,857 S * 4/1997 Hale ..... D25/164
5,640,801 A * 6/1997 Rynberk ..... A01G 9/28 47/33
5,692,348 A * 12/1997 Ambrosino ..... E04B 1/70 405/43
5,694,723 A * 12/1997 Parker ..... E02D 27/32 404/4
5,771,643 A * 6/1998 Parker ..... E02D 27/32 404/8
5,775,039 A * 7/1998 McPherson ..... E04B 1/7023 52/169.5
5,784,838 A * 7/1998 Phillips ..... E04F 17/00 405/44
5,794,388 A * 8/1998 Jackman ..... E04B 1/7023 405/36
5,836,135 A * 11/1998 Hagan ..... E04B 1/762 52/836
5,857,288 A * 1/1999 Wiste ..... A01G 9/28 47/33
5,937,600 A * 8/1999 Larson ..... E04B 1/762 52/302.6
5,946,870 A * 9/1999 Bifano ..... E04B 1/765 52/254
6,131,348 A * 10/2000 Dunham ..... E04F 13/06 52/287.1
6,241,421 B1 * 6/2001 Harvie ..... E02B 11/00 405/36
6,293,064 B1 * 9/2001 Larson ..... E04B 1/762 52/209
6,298,609 B1 * 10/2001 Bifano ..... E04B 1/765 52/101
6,308,470 B1 * 10/2001 Durkovic ..... E02D 27/02 405/36
6,379,078 B1 * 4/2002 Zwier ..... E01C 11/08 404/7
D456,911 S * 5/2002 Janesky ..... D25/119
6,385,898 B1 * 5/2002 Noel ..... A01G 9/28 47/33
6,385,932 B1 * 5/2002 Melchiori ..... E04F 13/06 52/302.3
6,568,126 B2 * 5/2003 Womack ..... A01K 63/00 47/33
6,591,559 B2 * 7/2003 Contreras ..... E04B 1/762 43/1
6,619,001 B1 * 9/2003 Pratt ..... E02D 31/02 52/169.5
6,672,016 B2 * 1/2004 Janesky ..... E02D 31/06 405/38
7,516,584 B2 * 4/2009 Valentine ..... E04F 19/04 52/287.1
7,546,713 B2 * 6/2009 Bradley ..... E04H 4/141 52/102
7,546,719 B1 * 6/2009 Guevara ..... E04F 13/06 52/302.6
7,591,106 B2 * 9/2009 Conlin ..... E04D 13/1475 52/302.6
7,634,883 B1 * 12/2009 Larson ..... E04F 13/06 52/393
7,712,267 B2 * 5/2010 Lehane ..... E04B 2/7453 52/169.5
7,774,993 B2 * 8/2010 Strobl, Jr. ..... A01G 9/28 52/102
7,810,291 B2 * 10/2010 McPherson ..... E02D 31/02 404/2
7,832,150 B1 * 11/2010 Pratt ..... E04B 1/7023 52/169.5
7,836,640 B1 * 11/2010 Pratt ..... E04B 1/7023 52/169.5
7,963,718 B2 * 6/2011 Zwier ..... E01C 11/221 404/7
8,006,441 B2 * 8/2011 Pulte ..... E04D 13/064 29/897.3
8,555,581 B2 * 10/2013 Amend ..... E04F 13/0875 52/302.1
8,578,660 B2 * 11/2013 Nolan ..... E04F 19/045 52/302.6
9,222,252 B1 * 12/2015 Williams ..... E04B 1/70
10,060,126 B2 * 8/2018 Collins ..... E04B 1/765
10,314,441 B2 * 6/2019 Kratzmann ..... A47K 3/30
2002/0139068 A1 * 10/2002 Janesky ..... E02D 31/06 52/169.5
2005/0166470 A1 * 8/2005 Allen ..... E06B 1/62 52/58
2005/0198916 A1 * 9/2005 Janesky ..... E02D 31/02 52/169.5
2006/0032158 A1 * 2/2006 Moule ..... E02D 31/06 52/169.5
2006/0137289 A1 * 6/2006 Cotten ..... E02D 31/02 52/717.02
2006/0254169 A1 * 11/2006 McFadden ..... E04F 13/06 52/344
2008/0163566 A1 * 7/2008 Bella ..... A01G 9/28 52/102
2009/0183445 A1 * 7/2009 McPherson ..... E02D 31/02 52/169.5
2009/0183453 A1 * 7/2009 Koessler ..... E04F 13/007 52/302.3
2012/0227336 A1 * 9/2012 Trebil ..... E04B 1/0007 52/169.5
2013/0205696 A1 * 8/2013 Little ..... E04F 13/06 52/255
2014/0041293 A1 * 2/2014 Kellogg ..... A01G 9/28 47/33
2014/0360109 A1 * 12/2014 Goldberg ..... E04B 1/70 52/169.5
2016/0069071 A1 * 3/2016 Remmele ..... E04F 13/068 52/232
2016/0115701 A1 * 4/2016 Baldoni ..... E04H 4/142 52/300
2017/0051471 A1 * 2/2017 Parks ..... E02D 31/025
2017/0254091 A1 * 9/2017 Friel ..... E04B 1/765
2018/0216309 A1 * 8/2018 McPherson ..... E02D 31/025
2019/0010720 A1 * 1/2019 Baldoni ..... B25B 27/02

* cited by examiner

WATER DRAINAGE EDGING

FIELD

The present invention relates, in general, to basement waterproofing systems, and more particularly to edging that directs water into the sub-floor drain conduit.

BACKGROUND

Basements of houses and buildings have a tendency to leak water due to the presence of water-laden soil adjacent to the basement walls and floor slab. The water leakage occurs even when various attempts have been made to prevent water from infiltrating the basement. Therefore, it is common to install a sub-floor drainage system, collection basket and pump to remove the water below the floor slab.

However, water can still infiltrate the basement through the concrete walls of the basement. There have been various attempts to direct this water through the walls and into the sub-floor drainage system. However, the currently-available devices to do this are deficient in one or more of a few key areas. For example most conventional wall drainage products allow soil gasses to vent into the living area of the home which leads to radon and mold issues. Also, conventional systems typically create an air gap between the footing and the floor and between the floor and the wall. These gaps can lead to the floor settling and the foundation wall pushing inward. Seams between adjacent sections of conventional edging further can leak with high volumes of water. In the average basement there would be approximately 20 to 50 seams that could potentially leak using the conventional technology. Thus, there is a need to provide improved edging systems that address these shortcomings.

SUMMARY

The invention, in certain embodiments, addresses the drawbacks of the prior art by providing a basement edging system, apparatus and method. The edging is used, for example, in retrofit basement drainage systems or in new construction. Its primary application is to route water that has collected in or against foundation walls from drainage holes drilled in the bottom of the walls and direct that water into drainage conduit located along the footing. The edging is poured into the concrete floor. The edging can be used in many types of structures where water routing is desired.

The disclosure includes a water drainage edging segment that includes a horizontally-extending bottom portion, a vertically extending top portion, and an angled intermediate section spanning between the bottom and top portions. The bottom portion defines a plurality of longitudinally spaced bottom channels that are oriented at one or both of a perpendicular angle and an oblique angle to the longitudinal axis of the edging segment. Each of the plurality of bottom channels are raised above a lowermost plane of the bottom portion to define an open passageway from a backside of the edging segment and laterally through the edging segment. The top portion defines a longitudinally extending upper rib portion that projects rearwardly from a front plane of the top portion to define a forward offset of the front plane and an upward facing contact surface.

The top portion can further define a rear spacer portion that projects rearward from the front plane of the edging segment to the same degree as the upper rib.

The rear spacer portion can span from the first longitudinal end of the edging segment to the second longitudinal end of the edging segment.

A series of longitudinally-spaced vertical channels can be defined into the rear spacer portion such that a vertical passageway is defined through the rear spacer portion.

The intermediate section can span from the rear spacer portion to the bottom portion and defines an offset of the bottom portion forward of a rear-most plane of the top portion.

The intermediate section can span in a straight line and intersect each of the vertical plane and the horizontal plane at an oblique angle.

The first longitudinal end can define an upper joining tongue and the opposing second longitudinal end can define a lower joining tongue. The upper joining tongue is offset such that the upper joining tongue overlaps the lower joining tongue when two adjacent edging segments are joined together longitudinally.

The edging segment can be configured as a straight section, inner corner section, outer corner section, or a curved section.

The edging segment can be formed of plastic and can be formed as one single piece.

The disclosure further includes a method of waterproofing a living space located below grade. The method includes disposing an edging segment vertically atop and contacting a footing while simultaneously contacting an inner surface of a wall that defines the living space. A concrete slab is created atop a bottom portion of the edging segment. A channel for water to flow is defined in the bottom portion of the edging segment. The water can flow through the edging segment from the wall to a drainage system located adjacent to the footing and below the concrete slab. A water collection space is defined between an intermediate section of the edging segment and the wall. The water collection space spans from a first longitudinal end of the edging segment to a second longitudinal end of the edging segment. A forward offset of a front plane of a top section of the edging segment from the wall is defined via an upper rib portion that projects towards the wall from the front plane of the top section. The upper rib portion extends longitudinally from the first longitudinal end of the edging segment to the second longitudinal end of the edging segment. An upward facing contact surface rearward of the front plane is defined via the upper rib portion.

A vapor barrier panel can be disposed against the wall with the bottom edge of the vapor barrier panel in contact with the upward facing contact surface of the upper rib. A foam rope can be disposed adjacent to a bottom edge of the vapor barrier panel along the upward facing contact surface.

A first tongue portion of the edging segment can be overlapped with a respective second tongue portion of a second edging segment.

The second edging segment can be configured as an inner corner segment, an outer corner segment, a straight segment or a curved segment.

The water channel in the bottom portion can be branched into multiple side branches.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

DETAILED DESCRIPTION

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention. The invention is to cover all modifications, equivalents, and alternatives falling within the scope of the invention as defined by the appended claims.

Figure 1:
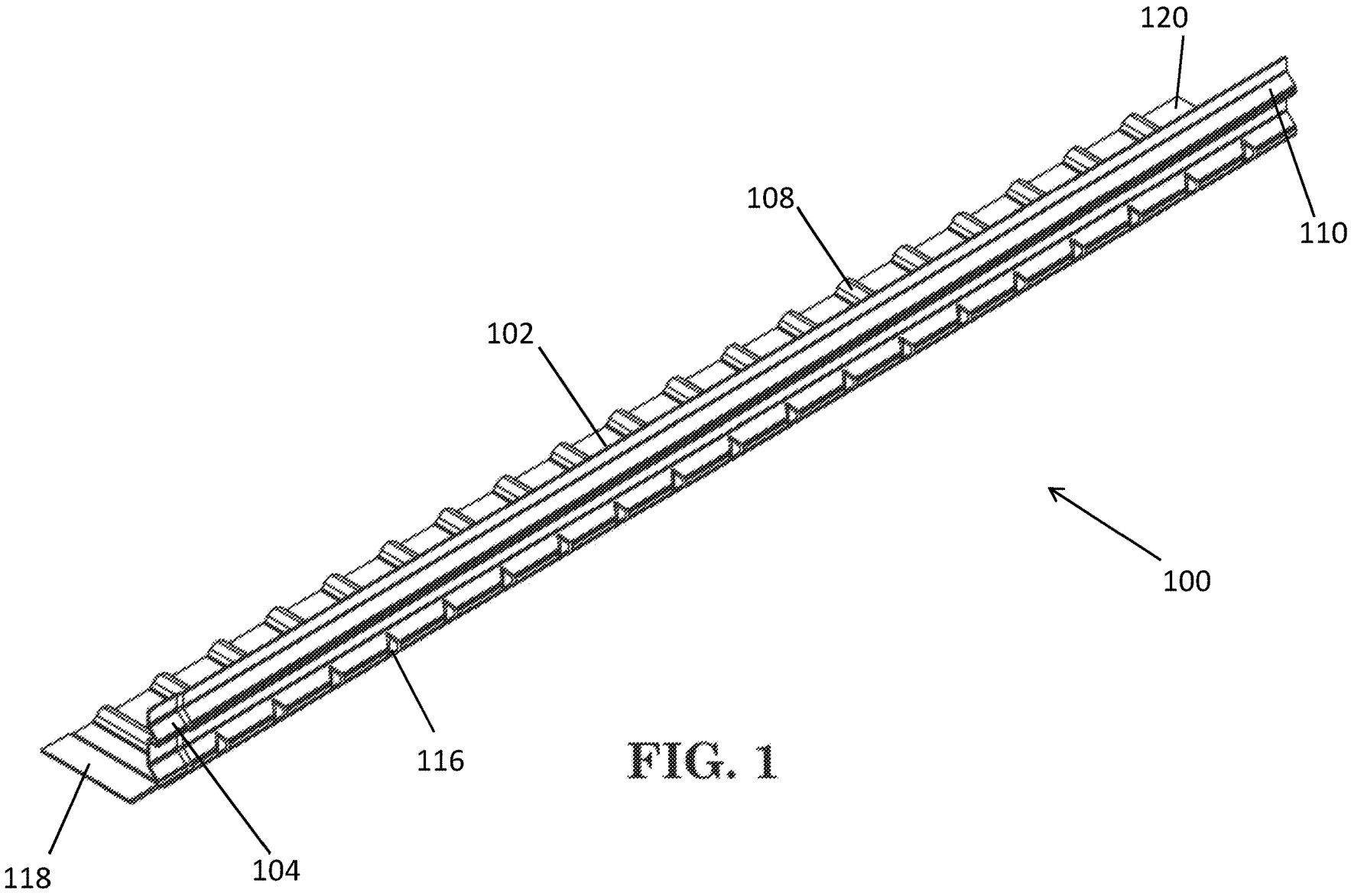
FIG. 1 is a perspective rear view of a straight section of wall edging in accordance with certain embodiments.
Figure 2:
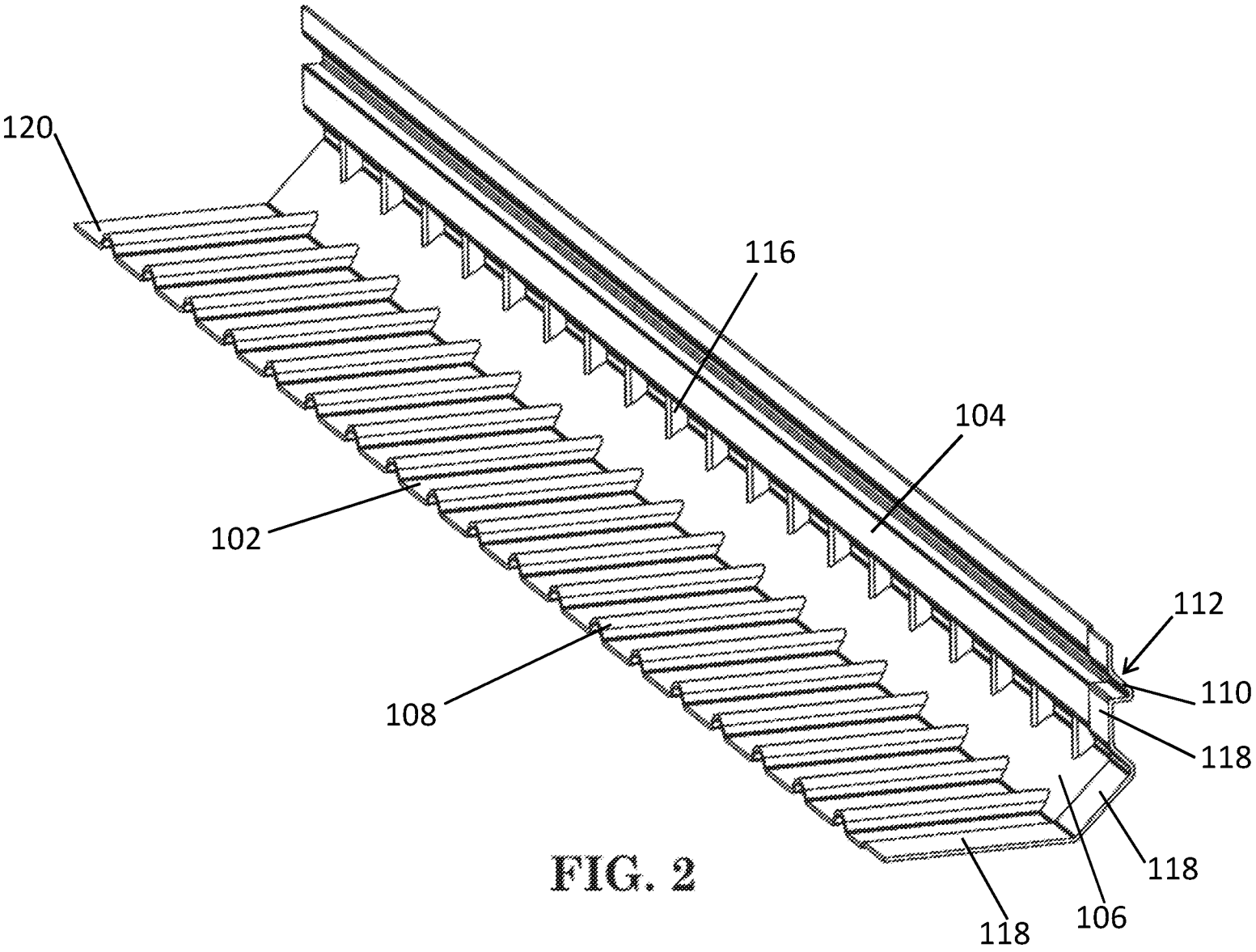
FIG. 2 is a perspective front view of the edging of FIG. 1.
Figure 3:
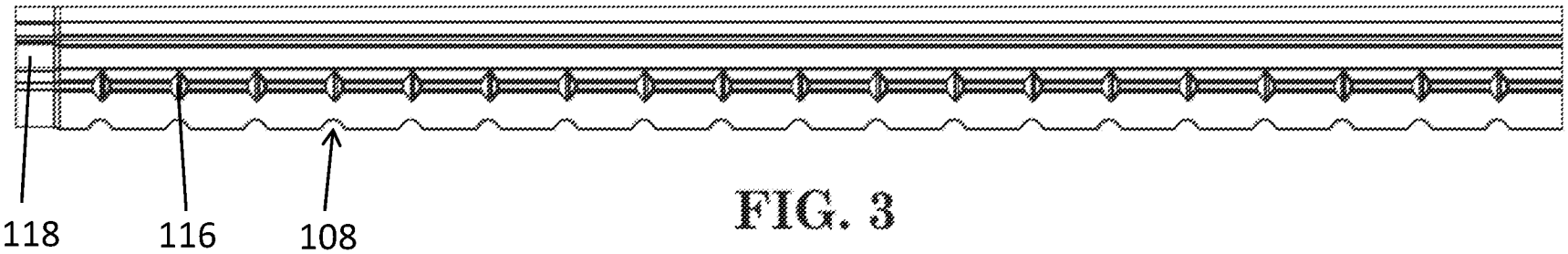
FIG. 3 is a front view of the edging of FIG. 1.
Figure 4:
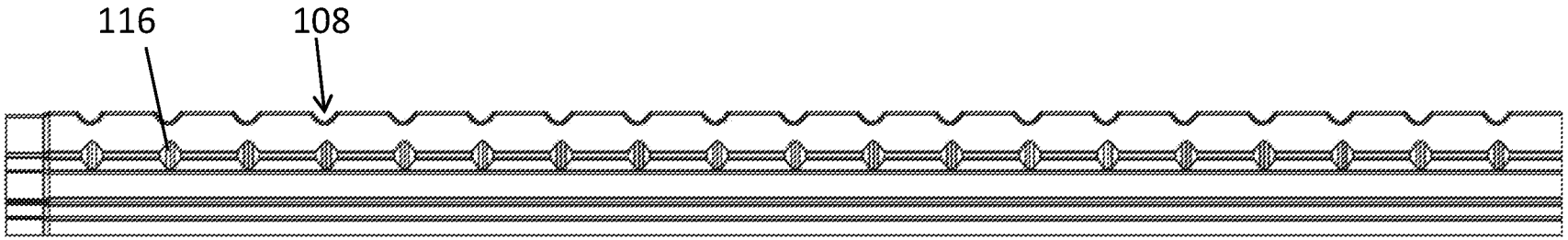
FIG. 4 is a rear view of the edging of FIG. 1.
Figure 5:
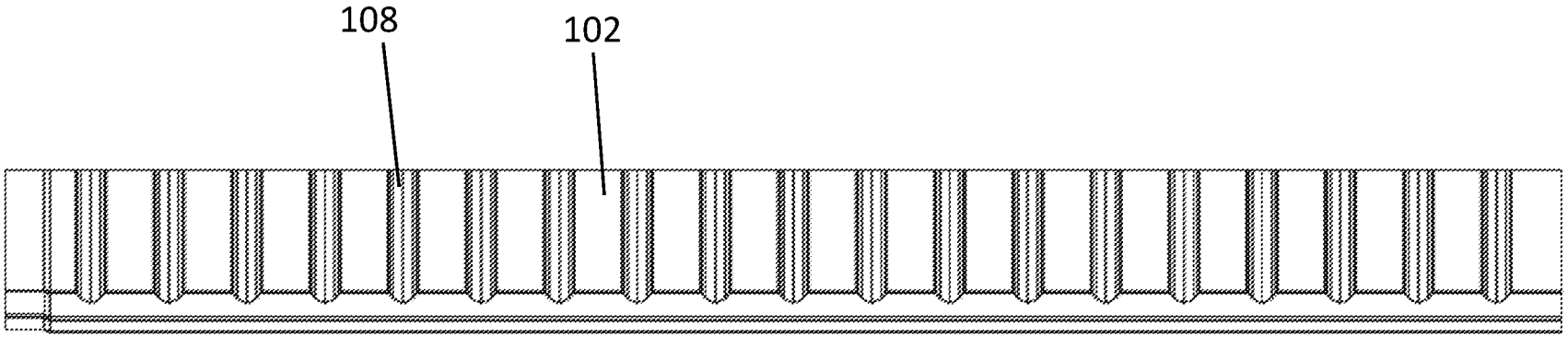
FIG. 5 is a top view of the edging of FIG. 1.
Figure 6:
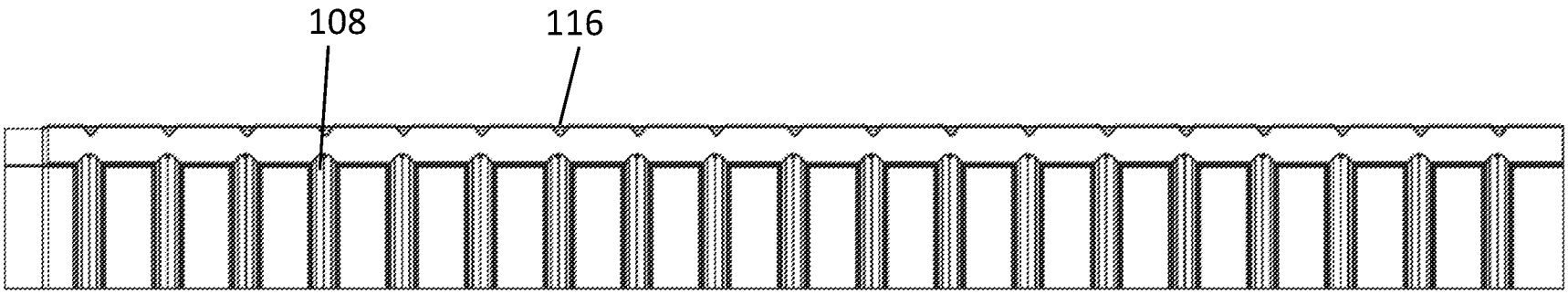
FIG. 6 is a bottom view of the edging of FIG. 1.
Figure 8:
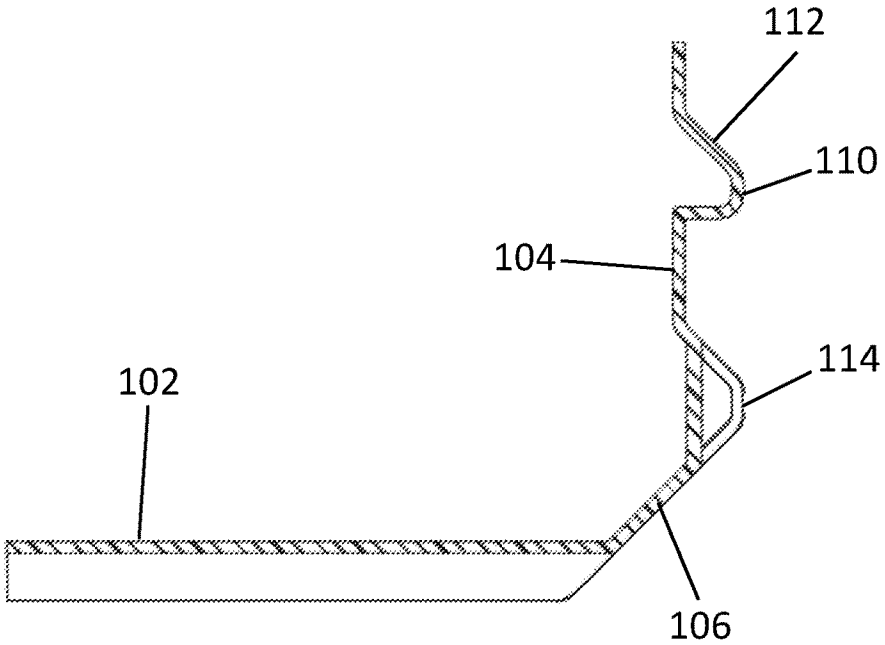
FIG. 8 is a cross-sectional view taken along the mid-line of the edging of FIG. 1.
Figure 7:
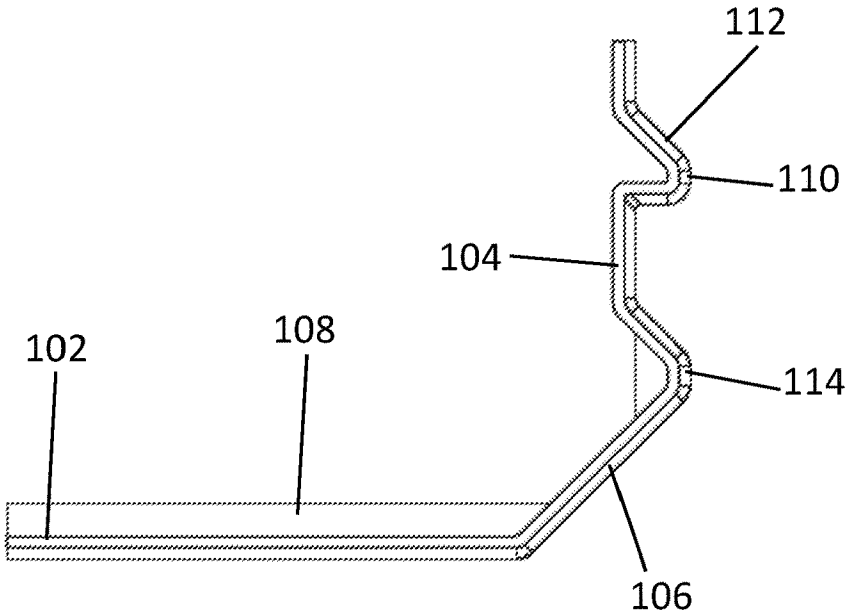
FIG. 7 is an end view of the edging of FIG. 1.

Referring to FIGS. 1-7, a segment of edging 100 is shown. A cross-section along the midline of the edging 100 is shown in FIG. 8. Each edging 100 segment is elongated in a longitudinal length direction as compared to a lateral depth direction. The edging section generally defines a horizontally-extending bottom portion 102, a vertically extending top portion 104 and an angled intermediate section 106 spanning between the bottom 102 and top 104 portions. Of course, the top and bottom portions are not planar due to the contour features defined in each that will now be discussed.

The bottom portion 102 defines a plurality of longitudinally spaced bottom channels 108 that are oriented perpendicular (or other oblique angle) to the longitudinal axis of the edging 100. The bottom channels are raised above the lowermost plane of the edging 100 to define an open passageway from the backside (wall side) of the edging through the edging so that the water can pass into the drain tile or other drain material below the basement concrete slab.

The top portion 104 defines a longitudinally extending upper rib 110 portion spanning the longitudinal length of the edging 100. The upper rib 110 projects rearwardly (wall side) from the front plane of the front side to define a forward offset of the front plane of the top portion 106. A top surface of the upper rib 110 defines a contact surface 112 on which a wall panel or other structure can be disposed as will be explained later in this application.

The top portion 104 also defines a rear spacer portion 114 that stabilizes the edging 100 against the basement wall because the rear spacer portion 114 provides a second point of contact with the basement wall. The rear spacer portion 114 projects rearward from the front plane of the edging 100 to the same degree as the upper rib 110. The rear spacer portion 114 spans the entire longitudinal length of the edging 100 segment.

A series of longitudinally-spaced vertical channels 116 are defined into the rear spacer portion 114 to allow for any water exiting the basement wall above the rear spacer portion 114 to flow downwards past the rear spacer portion 114 via the vertical channels 116. The vertical channels 116 also strengthen the edging 100 so that the top portion 102 better resists torsional bending towards the bottom portion 102 as compared to the omission of the vertical channels 116.

The intermediate section 106 spans from the rear spacer portion 114 of top portion 104 to the bottom plane of the bottom portion 102. The span can be generally straight or can be any other shape or combination of shapes. The intermediate section 106 shown in the figures is straight and intersects each of the vertical plane and the horizontal plane at an oblique angle. Regardless of shape, the intermediate section 106 defines an offset of the bottom portion 102 forward of the basement wall so that there is adequate open space for water to collect and flow longitudinally behind the edging. This allows the water to flow to and exit multiple bottom channels 108. This also guards against the occurrence of a blockage in one or more of the channels 108 because there are many more unblocked channels for the water to exit through.

Each edging segment is also configured to overlap an adjacent edging segment when two such segments are joined together. A first longitudinal end of the edging segment 100 defines an upper joining tongue 118 and the opposing second longitudinal end defines a lower joining tongue 120. The upper joining tongue 118 is spaced forward (away from the wall and above the floor slab, respectively) of each of the top portion 102, bottom portion 104 and intermediate section 106 by approximately the thickness of the material from which the edging is formed.

Figure 9:
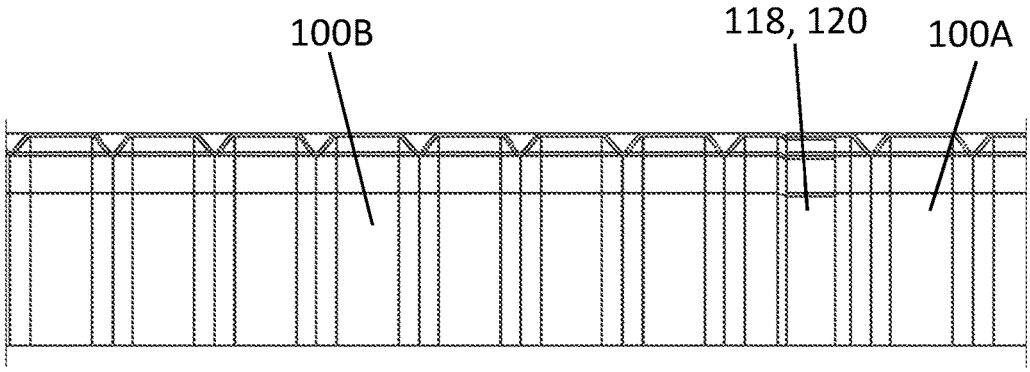
FIG. 9 is a top view showing overlapping joining of two straight segments of edging in accordance with certain embodiments.
Figure 10:
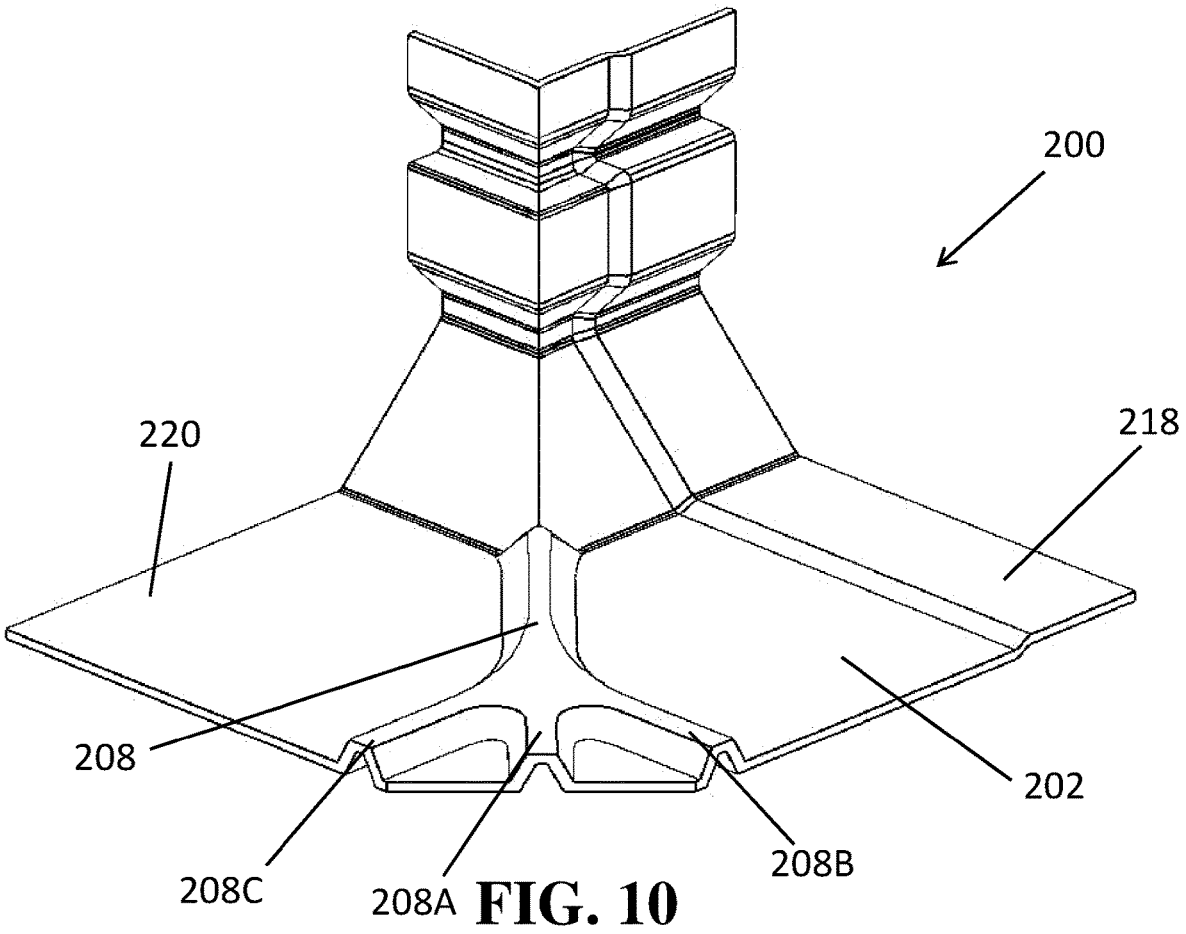
FIG. 10 is a perspective view of an outside corner segment of edging in accordance with certain embodiments.
Figure 11:
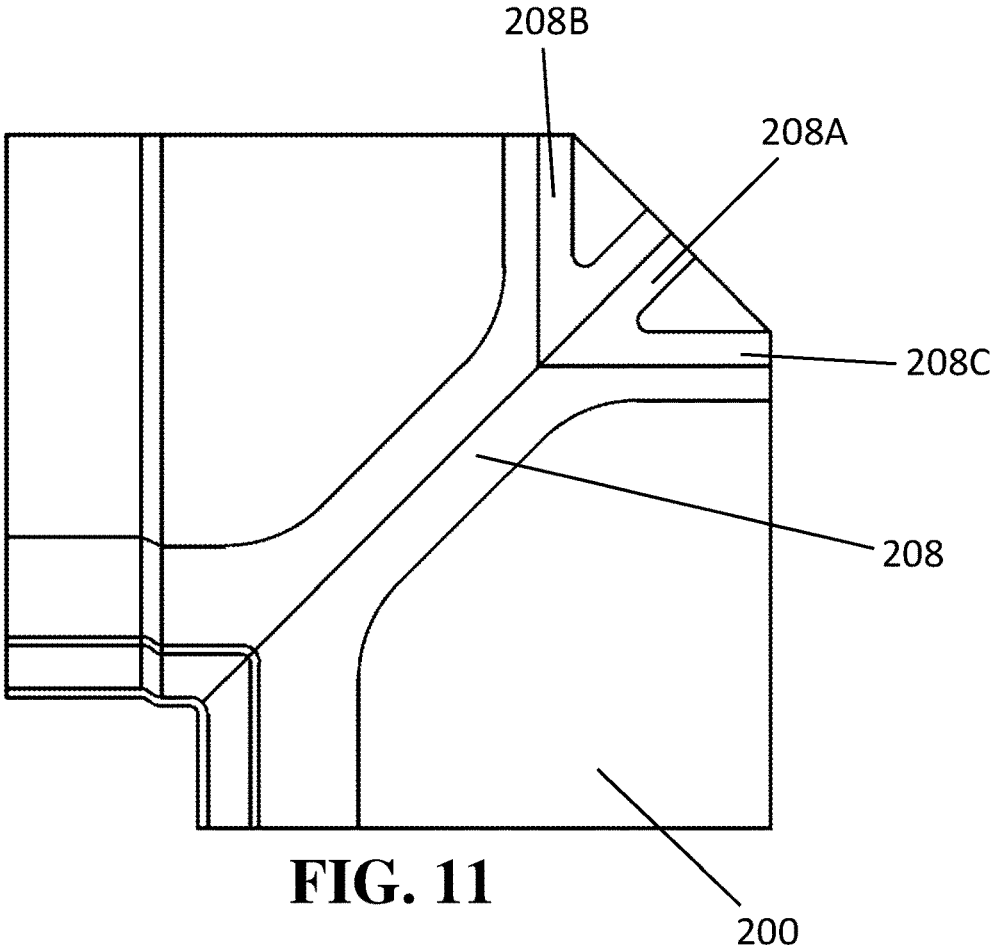
FIG. 11 is a top view of the outside corner segment of FIG. 10.
Figure 12:
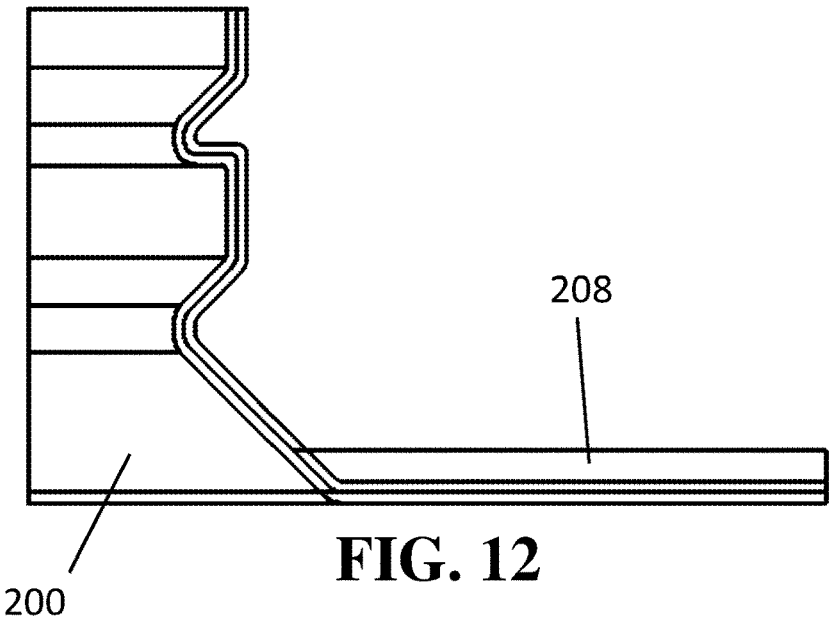
FIG. 12 is a side view of the outside corner segment of FIG. 10.
Figure 13:
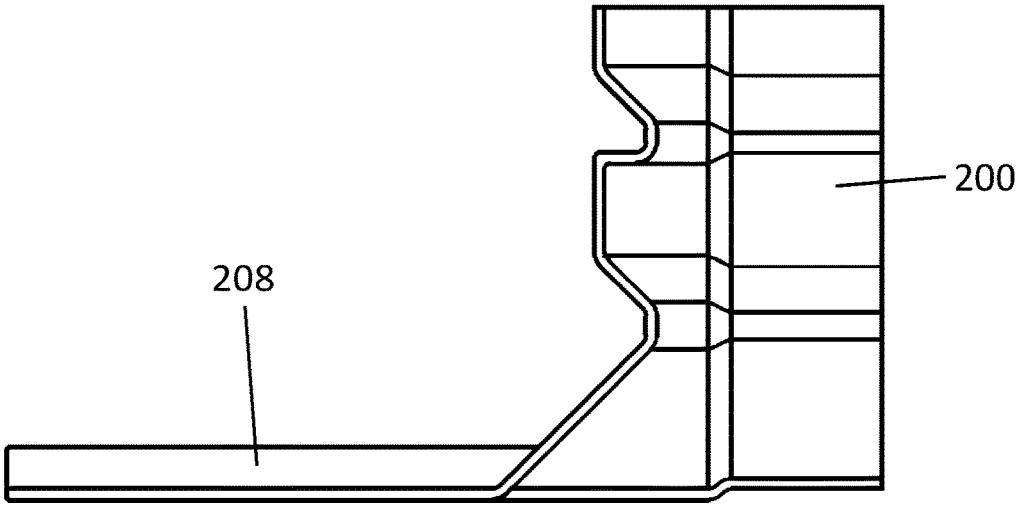
FIG. 13 is a front view of the outside corner segment of FIG. 10.
Figure 14:
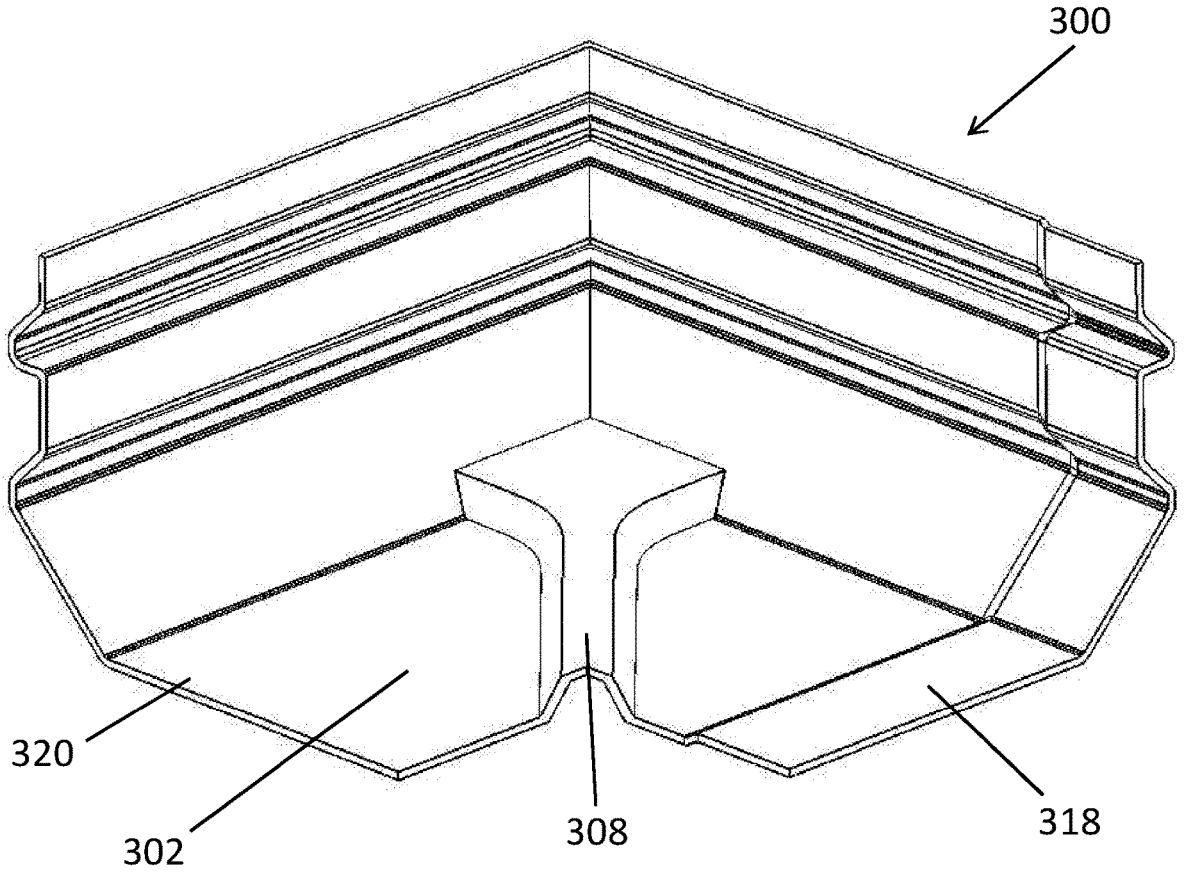
FIG. 14 is a perspective view of an inside corner segment of edging in accordance with certain embodiments.
Figure 15:
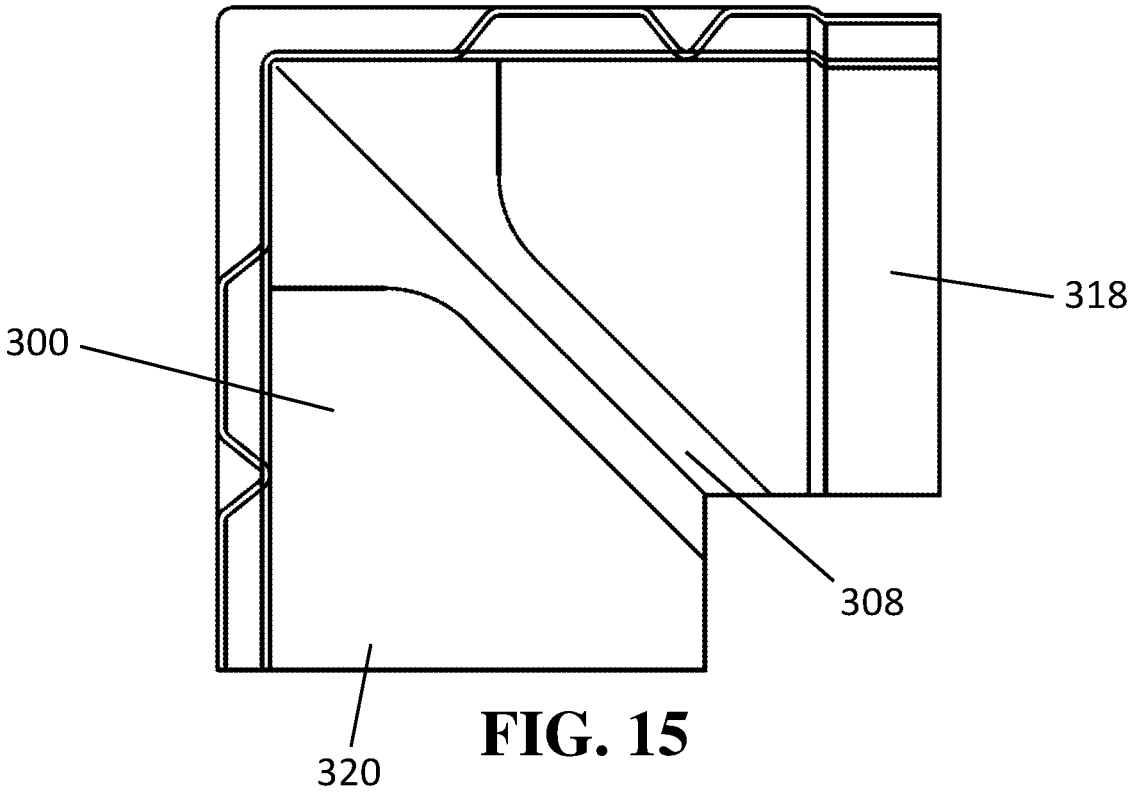
FIG. 15 is a top view of the inside corner segment of FIG. 14.
Figure 16:
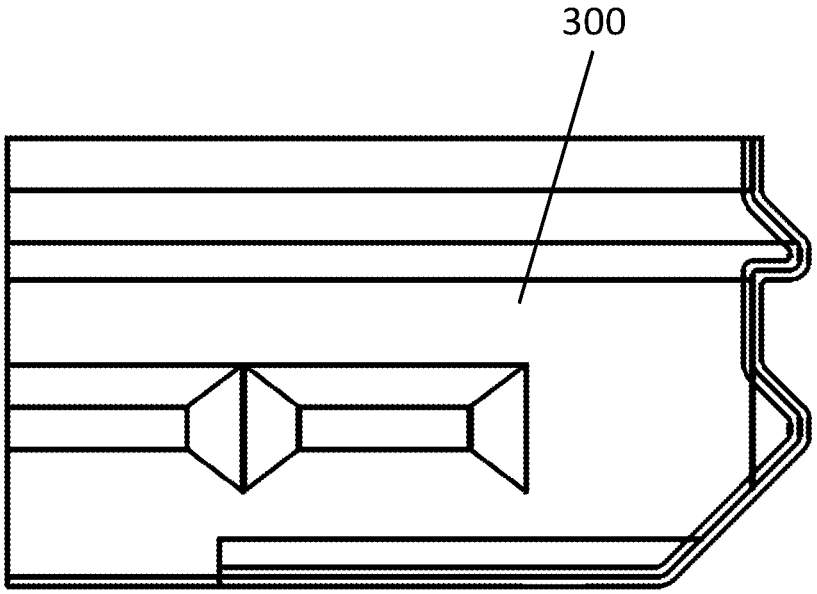
FIG. 16 is a side view of the inside corner segment of FIG. 14.
Figure 17:
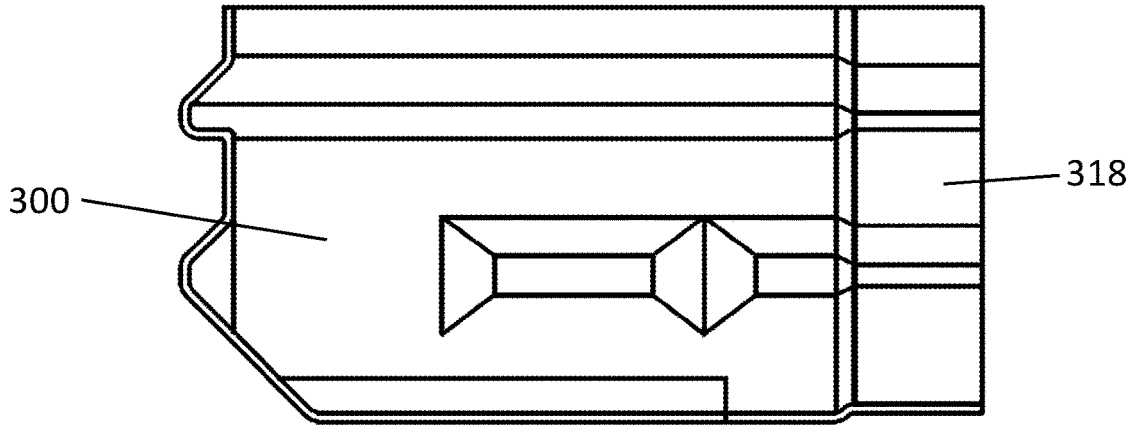
FIG. 17 is a front view of the inside corner segment of FIG. 14.

The adjacent edging segments are joined in a series fashion as illustrated in FIG. 9. The upper tongue portion 118 of a first segment 100A is disposed atop the lower tongue segment 120 of a second adjacent segment 100B so that the respective tongues 118, 120 overlap one another in the region indicated by arrow A. Sealant, such as silicon sealant, glue or other sealing agent can be applied to one or more of the tongues before joining in order to enhance the watertight seam formed by the overlapping tongues.

Referring now to FIGS. 10-13, an outside corner 200 embodiment of the edging is shown. This configuration fits against a 90 degree outer corner of the basement wall. In this embodiment, a single channel 208 is defined in the bottom portion 202 and extends at an approximate 45 degree angle to the outer sides (which are 90 degrees to one another). Of course a different angle could also be provided. The channel 208 branches into left 208B and right 208C branches (the center branch is designated as 208A) prior to exiting the perimeter of the edging. These side branches 208B and 208C help reduce water pressure in the main branch 208A and provide alternate routes in the event of a clog in one branch.

Figure 18:
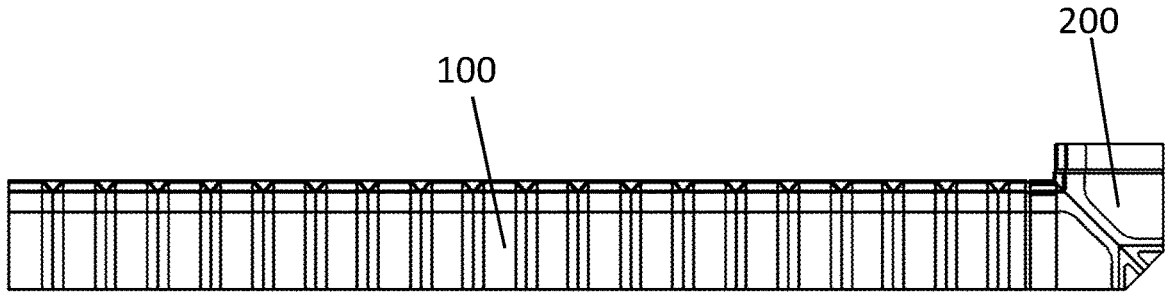
FIG. 18 is a top view showing overlapping joining of a straight segment of edging with an outer corner edging segment in accordance with certain embodiments.

As with the straight edging embodiment, one end has an upper tongue 218 to overlap the lower tongue 220 to provide a sealing surface. FIG. 18 illustrates a straight section of edging 100 joined with an outside corner edging section 200.

Referring now to FIGS. 14-17, an inside corner 300 embodiment of the edging is shown. This configuration fits into a 90 degree inner corner of the basement wall. In this embodiment, a single channel 308 is defined in the bottom portion 302 and extends at an approximate 45 degree angle to the outer sides (which are 90 degrees to one another). Of course a different angle could also be provided.

Figure 19:
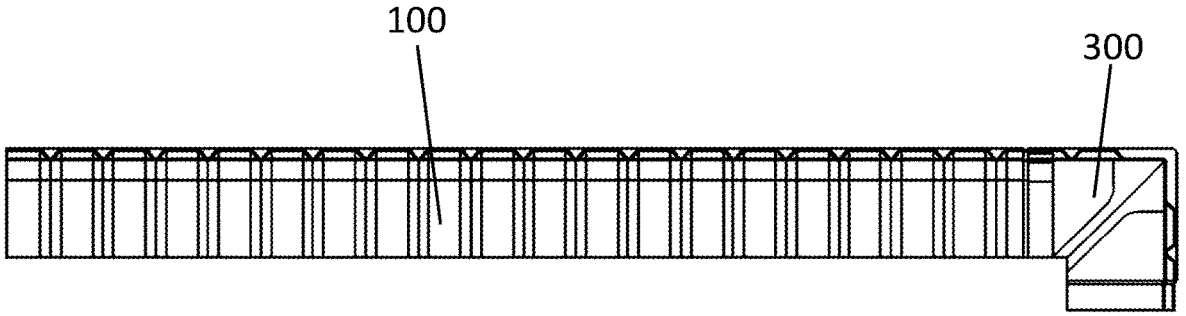
FIG. 19 is a top view showing overlapping joining of a straight segment of edging with an inside corner edging segment in accordance with certain embodiments.

As with the straight edging 100 and outer corner 200 embodiments, one end has an upper tongue 318 to overlap the lower tongue 320 to provide a sealing surface. FIG. 19 illustrates a straight section of edging 100 joined with an inside corner edging section 300.

Figure 20:
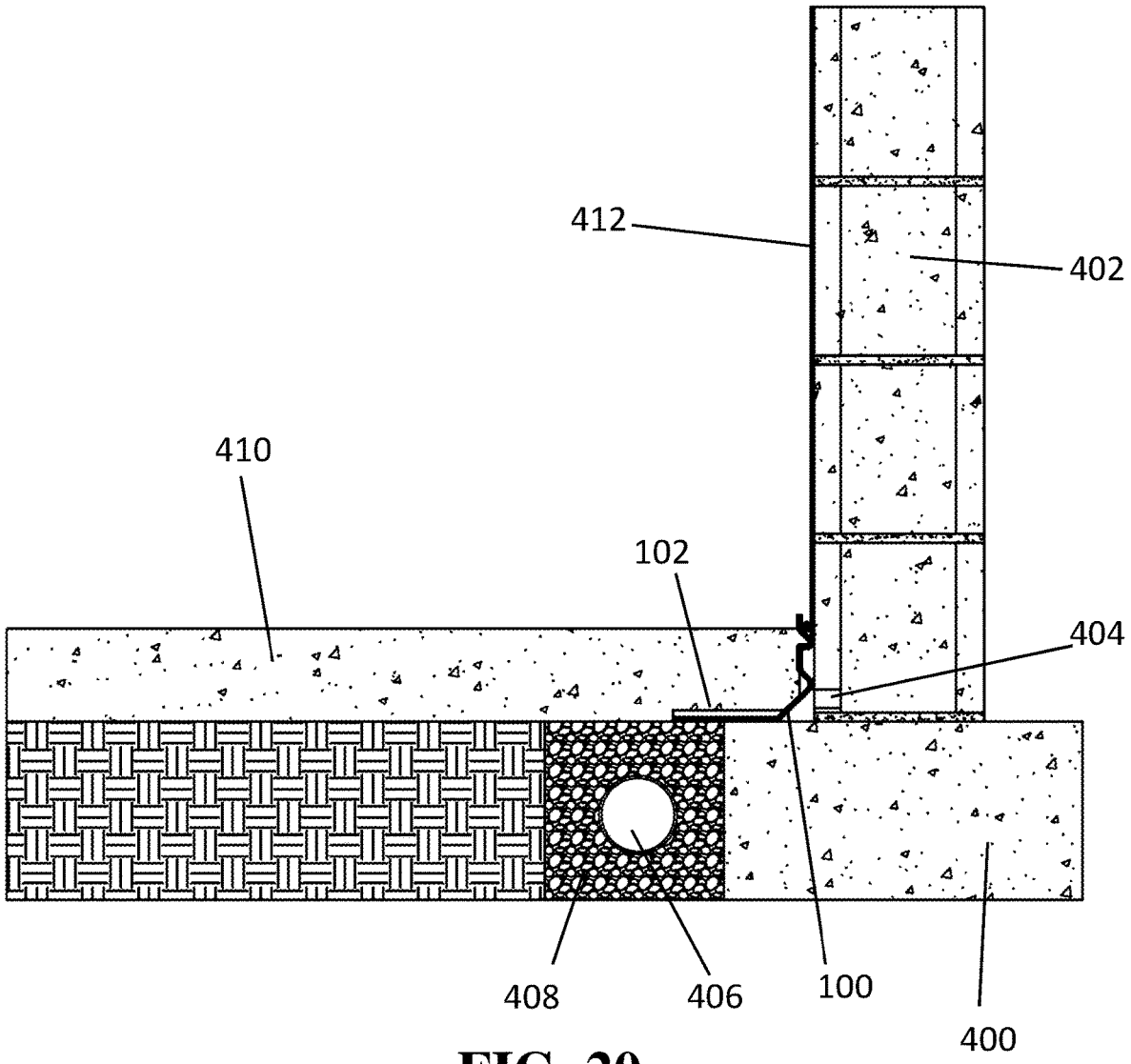
FIG. 20 is a side cross-section of the wall edging installed in a basement as part of a water drainage system in accordance with certain embodiments.
Figure 21:
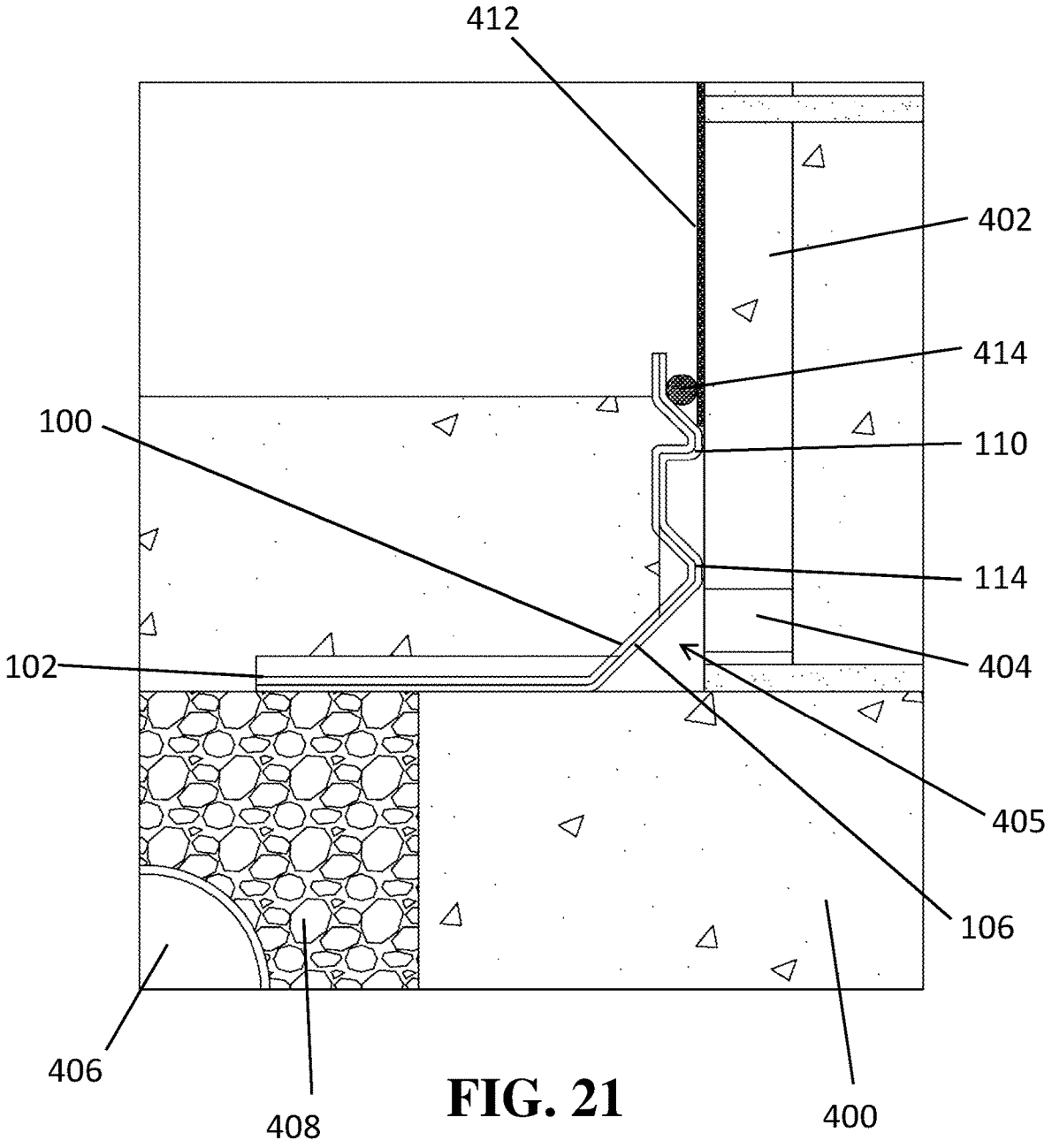
FIG. 21 is a close-up view of a portion of FIG. 18 showing the edging.

FIGS. 20-21 are a cross-sectional view of a portion of a basement showing a section of edging 100 installed in use. The bottom portion 102 of the edging 100 is laid against and in contact with the footing 400. The upper rib 110 and rear spacer portions 114 contact the inside (interior) surface block wall 402. A drainage hole 404 is formed in the lowermost block of the wall 402 to permit water to flow out of the cavities in the blocks. Each block in the lowermost row of blocks can be provided with this drainage hole. A water collection space 405 is defined behind the intermediate section 106 of the edging 100 and bounded by the wall 402 and footing 400.

Drain tile, or a drain conduit 406 disposed within a gravel trench 408, is formed adjacent to the footing 400. Water can move freely through the gravel and enter openings or pores in the conduit 406. The water then flows through the conduit and is collected in a sump basket (not shown). Water collected in the sump basket is periodically pumped out with a sump pump.

The concrete floor slab 410 in poured atop the edging 100. Thus, the edging 100 is located between the slab 406 and footing 400 in the vertical direction and between the slab 406 and the wall 402 in the horizontal direction.

The bottom portion 102 of the edging extends horizontally away from the wall 402 sufficiently so that the channels 108 provide a path for the water to flow into the gravel 408.

It should be noted that the block wall 402 could also be formed via poured concrete instead of concrete blocks.

A vapor barrier panel 412 or film can be provided against the block wall. The bottom edge of the panel 412 is disposed within the space defined by the contact surface 112 and upper edge of the edging panel 100 as shown in FIGS. 20-21. A backer rod or foam rope 414 can be disposed in this space adjacent to the bottom edge of the panel 412 in order to secure and seal the panel in place with the edging 100. Water or moisture penetrating through the wall 402 above the lowermost block can thus be directed downward into the edging behind the panel (wall side) 412 so that the moisture does not enter the living space of the basement. That water then collects in the collection gap 405 formed behind the intermediate section 106, which then flows out to the gravel 408 and drain conduit 406 via the channels 108.

The backer rod or foam rope 414 can be selected for size and composition to accommodate a wide variety of vapor barrier sides and types.

As can be appreciated by the above descriptions, the edging can be part of a sealed system to prevent water intrusion into the living space of a basement or other living space located below grade. In addition, the edging described herein can be used in conjunction with conventional radon mitigation and water mitigation systems in a house or building. Thus, the edging can be readily retrofit to existing structures. The edging can also be installed with new construction.

The various edging 100, 200, 300 segments are preferably formed as a unitary (i.e., one-piece) construction from a plastic material. High volume vacuum forming manufacturing processes can be employed to make the complex shapes disclosed herein that allow the contour of the edging to make contact with the block wall minimizing the transfer of air from the soil to the living area of the home.

Edging segments of varying lengths can be provided, such as for example, 4, 6, 8, 10 and 12 foot lengths. Other lengths can be provided and each segment can also be trimmed to a custom length using conventional saws or plastic cutting tools. The edging segments can be formed of a thermal formable plastic or other suitable material.

The water draining edging described herein improves indoor air quality compared to many conventional edging products. Most conventional products allow soil gasses to vent into the living area of the basement of the home which leads to radon and mold issues in the basement and throughout the house or building. The shape and design of the edging disclosed herein minimizes the air gap between the floor and wall, allowing for a semi sealed system that makes it tunable and able to work in conjunction with modern radon and moisture mitigation systems.

The water draining edging described herein also improves structural issues in basements. Most conventional edging products create an air gap between the footing and the floor and between the floor and the wall. These gaps can lead to the floor settling and the foundation wall pushing inward. The shape and design of the edging disclosed herein allows water to drain while allowing the concrete floor to make full contact from the floor to the footing and the wall, thereby eliminating structural failures, and not sacrificing water drainage volume.

The water draining edging described herein further advantageously addresses seam leakage. Seam leakage presents water and radon infiltration plus mold growth. Conventional edging products are joined such that the resulting seams leak with high volumes of water. The shape and design of the edging disclosed herein provides the overlapping tongues at the ends of every segment to allow a greater sealing surface and to allow the installer to glue and seal the seams. This configuration has been found to eliminate seam leakage.

The various features or aspects discussed herein can also be combined in additional combinations and embodiments, whether or not explicitly discussed herein, without departing from the scope of the invention.

While the invention has been described in connection with what is presently considered to be the most practical and preferred example embodiments, it will be apparent to those of ordinary skill in the art that the invention is not to be limited to the disclosed example embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A water drainage edging segment that is elongated in a longitudinal direction and defining a longitudinal axis, the water drainage edging segment comprising:

a horizontally-extending bottom portion;

a vertically-extending top portion; and an angled intermediate section spanning between the horizontally-extending bottom portion and the vertically-extending top portion, wherein the horizontally-extending bottom portion defines a plurality of longitudinally spaced bottom channels projecting above an uppermost plane of the horizontally-extending bottom portion that are oriented at at least one of a perpendicular angle and an oblique angle to the longitudinal axis of the water drainage edging segment, wherein each of the plurality of longitudinally spaced bottom channels are raised above a lowermost plane of the horizontally-extending bottom portion to define an open passageway from a backside of the water drainage edging segment and laterally through the water drainage edging segment, wherein the vertically-extending top portion defines a longitudinally extending upper rib portion spanning from a first longitudinal end of the water drainage edging segment to an opposing second longitudinal end of the water drainage edging segment, wherein the longitudinally extending upper rib projects rearwardly from a front plane of the vertically-extending top portion to define a forward offset of the front plane and an upward facing contact surface, and wherein the water drainage edging segment is formed as one single piece.

2. The water drainage edging segment of claim 1, wherein the vertically-extending top portion further defines a rear spacer portion that projects rearward from the front plane of the water drainage edging segment to the same degree as the longitudinally extending upper rib.

3. The water drainage edging segment of claim 2, wherein the rear spacer portion spans from the first longitudinal end of the water drainage edging segment to the second longitudinal end of the water drainage edging segment.

4. The water drainage edging segment of claim 2, wherein a series of longitudinally-spaced vertical channels are defined into the rear spacer portion such that a vertical passageway is defined through the rear spacer portion.

5. The water drainage edging segment of claim 2, wherein the angled intermediate section spans from the rear spacer portion to the horizontally-extending bottom portion and defines an offset of the horizontally-extending bottom portion forward of a rear-most plane of the vertically-extending top portion.

6. The water drainage edging segment of claim 5, wherein the angled intermediate section spans in a straight line and intersects each of the vertical plane and the horizontal plane at an oblique angle.

7. The water drainage edging segment of claim 1, wherein the first longitudinal end defines an upper joining tongue and the opposing second longitudinal end defines a lower joining tongue, wherein the upper joining tongue is offset such that the upper joining tongue overlaps the lower joining tongue when two adjacent water drainage edging segments are joined together longitudinally.

8. The water drainage edging segment of claim 1, wherein the water drainage edging segment is configured as a straight section.

9. The water drainage edging segment of claim 1, wherein the water drainage edging segment is formed of plastic.

10. A water drainage edging segment that is elongated in a longitudinal direction and defining a longitudinal axis, the water drainage edging segment comprising:

a horizontally-extending bottom portion;

a vertically-extending top portion; and an angled intermediate section extending directly from the horizontally-extending bottom portion and towards the vertically-extending top portion, wherein the horizontally-extending bottom portion defines a plurality of longitudinally spaced bottom channels that are oriented at at least one of a perpendicular angle and an oblique angle to the longitudinal axis of the water drainage edging segment, wherein each of the plurality of longitudinally spaced bottom channels are raised above a lowermost plane of the horizontally-extending bottom portion to define an open passageway from a backside of the water drainage edging segment and laterally through the water drainage edging segment, wherein the vertically-extending top portion defines a longitudinally extending upper rib portion spanning from a first longitudinal end of the water drainage edging segment to an opposing second longitudinal end of the water drainage edging segment, wherein the longitudinally extending upper rib projects rearwardly from a front plane of the vertically-extending top portion to define a forward offset of the front plane and an upward facing contact surface, and wherein the water drainage edging segment is formed as one single piece.

11. The water drainage edging segment of claim 10, wherein the angled intermediate section extends to a distal-most point of the vertically-extending top portion.

12. The water drainage edging segment of claim 11, wherein the plurality of longitudinally spaced bottom channels project above an uppermost plane of the horizontally-extending bottom portion.

13. The water drainage edging segment of claim 11, wherein the vertically-extending top portion is bent to define the longitudinally extending upper rib portion.

14. The water drainage edging segment of claim 10, wherein the plurality of longitudinally spaced bottom channels project above an uppermost plane of the horizontally-extending bottom portion.

15. The water drainage edging segment of claim 14, wherein the vertically-extending top portion is bent to define the longitudinally extending upper rib portion.

16. A water drainage edging segment that is elongated in a longitudinal direction and defining a longitudinal axis, the water drainage edging segment comprising:

a horizontally-extending bottom portion;

a vertically extending top portion; and an angled intermediate section spanning between the horizontally-extending bottom portion and the vertically-extending top portion, wherein the horizontally-extending bottom portion defines a plurality of longitudinally spaced bottom channels that are oriented at at least one of a perpendicular angle and an oblique angle to the longitudinal axis of the water drainage edging segment, wherein each of the plurality of longitudinally spaced bottom channels are raised above a lowermost plane of the horizontally-extending bottom portion to define an open passageway from a backside of the water drainage edging segment and laterally through the water drainage edging segment, wherein the vertically-extending top portion is bent to define a longitudinally extending upper rib portion spanning from a first longitudinal end of the water drainage edging segment to an opposing second longitudinal end of the water drainage edging segment, wherein the longitudinally extending upper rib projects rearwardly from a front plane of the vertically-extending top portion to define a forward offset of the front plane and an upward facing contact surface, and wherein the water drainage edging segment is formed as one single piece.

17. The water drainage edging segment of claim 16, wherein the angled intermediate section extends to a distalmost point of the vertically-extending top portion.

18. The water drainage edging segment of claim 17, wherein the plurality of longitudinally spaced bottom channels project above an uppermost plane of the horizontally-extending bottom portion.

19. The water drainage edging segment of claim 16, wherein the plurality of longitudinally spaced bottom channels project above an uppermost plane of the horizontally-extending bottom portion.

* * * * *